US011384499B2

(12) United States Patent
Luke et al.

(10) Patent No.: US 11,384,499 B2
(45) Date of Patent: Jul. 12, 2022

(54) DRAINAGE CHANNEL SUPPORT ASSEMBLY

(71) Applicant: RELN PTY LTD, Ingleburn (AU)

(72) Inventors: Owen Edward Luke, Ingleburn (AU); Luke Nigel Nattrass, Ingleburn (AU)

(73) Assignee: RELN PTY LTD, Ingleburn (AU)

( * ) Notice: Subject to any disclaimer, the term of this patent is extended or adjusted under 35 U.S.C. 154(b) by 0 days.

(21) Appl. No.: 17/269,778

(22) PCT Filed: Aug. 16, 2019

(86) PCT No.: PCT/AU2019/050858

§ 371 (c)(1),
(2) Date: Feb. 19, 2021

(87) PCT Pub. No.: WO2020/041823

PCT Pub. Date: Mar. 5, 2020

(65) Prior Publication Data

US 2021/0317627 A1 Oct. 14, 2021

(30) Foreign Application Priority Data

Aug. 29, 2018 (AU) ..... 2018903170

(51) Int. Cl.
*E03F 5/04* (2006.01)
*E02B 11/00* (2006.01)
*E03F 3/04* (2006.01)

(52) U.S. Cl.
CPC ..... *E02B 11/005* (2013.01); *E03F 3/046* (2013.01); *E03F 2005/0412* (2013.01)

(58) Field of Classification Search
CPC ..... E03F 2005/0412; E03F 2005/0413
(Continued)

(56) References Cited

U.S. PATENT DOCUMENTS 4,498,807 A 2/1985 Kirkpatrick et al.
5,372,457 A 12/1994 Rante
(Continued)

FOREIGN PATENT DOCUMENTS

JP 10-306490 A * 11/1998
KR 101865749 6/2018

OTHER PUBLICATIONS

International Search Report and Written Opinion issued in application No. PCT/AU2019/050858 dated Nov. 12, 2019.

*Primary Examiner* — Sunil Singh
(74) *Attorney, Agent, or Firm* — Workman Nydegger

(57) ABSTRACT

A drainage channel support assembly including a support member adapted to support drainage channel, a pair of pegs arranged to anchor the support member to the ground, and a pair of coupling elements mounted to respective of each of the pair of pegs. The coupling arrangements are configured where on anchoring of the support member to the ground via respective of the pair of pegs either: in a first install mode, the coupling arrangement contacts an upper surface of the support member with the associated peg penetrating the ground along substantially the full length of the peg; or, in a second install mode, the coupling arrangement couples to a fitting which contacts the upper surface of the support member, the coupling arrangement contacting a lower surface of the support member for suspension of the drainage channel above the ground.

13 Claims, 13 Drawing Sheets

(58) Field of Classification Search
USPC ..... 404/2, 3; 405/118, 119
See application file for complete search history.

(56) References Cited

U.S. PATENT DOCUMENTS

| | | | | |
|---|---|---|---|---|
| 5,718,537 | A | 2/1998 | Becker et al. | |
| 5,735,637 | A | 4/1998 | Gunter | |
| 6,227,763 | B1 | 5/2001 | Kuhns | |
| 8,475,079 | B2 * | 7/2013 | Humphries ..... | E03F 3/046 405/118 |
| 2015/0308092 | A1 | 10/2015 | Chromey et al. | |
| 2016/0319530 | A1 * | 11/2016 | Files, Jr. ..... | E03F 3/046 |

* cited by examiner

DRAINAGE CHANNEL SUPPORT ASSEMBLY

The present application is a U.S. National Stage of International Application No. PCT/AU2019/050858, filed on Aug. 16, 2019, designating the United States and claiming the priority of Australian Patent Application No. AU2018903170 filed with the Australian Patent Office on Aug. 29, 2018. All of the aforementioned applications are incorporated herein in their respective entireties by this reference.

TECHNICAL FIELD

The present invention relates broadly to a drainage channel support assembly. The invention is also broadly directed to a peg assembly associated with a support member for supporting a drainage channel.

BACKGROUND OF INVENTION

Surface water drainage systems have application in landscaping where the channel is either located in-ground for softscape applications, or located in a concrete surround poured in a trench. For the concrete pour option, the channel is initially suspended in the trench via upright rods driven into the ground. The channel may include integral clips extending from its opposing sides, the clips designed to grip the upright rods at the required height for suspension of the channel. In another arrangement suitable for the concrete pour, the channel rests upon a transverse bridge member which is clamped at its opposing ends to the upright rods on opposing sides of the channel. The channel appropriate for installation in softscape thus requires modification for application in concrete, for example by moulding clips to the sides of the channel. On the other hand, if the softscape channel is to be installed in concrete it requires additional components including the bridge member which must not only be clamped to the upright rods but also requires securement to the channel to prevent it floating during a concrete pour. It can also be cumbersome and time consuming to locate the bridge member at the required height relative to the upright rods to ensure the necessary fall in the channel is achieved.

SUMMARY OF INVENTION

According to a first aspect of the present invention there is provided a drainage channel support assembly comprising:

a support member adapted to locate underneath a drainage channel to support it;

a pair of pegs arranged to cooperate with the support member at each of its respective opposing ends for anchoring of the support member to the ground;

a pair of coupling arrangements mounted to respective of each of the pair of pegs, each of said coupling arrangements being configured where on anchoring of the support member to the ground via respective of the pair of pegs, said coupling arrangement either:

i) in a first install mode for the drainage channel contacts an upper surface of the support member with the associated peg penetrating the ground along substantially the full length of the peg beneath the coupling arrangement, or ii) in a second install mode for the drainage channel couples to a fitting which contacts the upper surface of the support member, the coupling arrangement contacting a lower surface of the support member for suspension of the drainage channel above the ground with the peg penetrating the ground along part only of its full length.

According to a second aspect of the invention there is provided a peg assembly comprising:

a peg adapted to cooperate with a support member designed to support a drainage channel;

a coupling arrangement mounted to the peg, said coupling arrangement being configured where on anchoring of the support member to the ground via the peg, said coupling arrangement either:

i) in a first install mode for the drainage channel being arranged to contact an upper surface of the support member with the associated peg penetrating the ground along substantially the full length of the peg beneath the coupling arrangement, or ii) in a second install mode for the drainage channel couples to a fitting which contacts the upper surface of the support member, the coupling arrangement contacting a lower surface of the support member for suspension of the drainage channel above the ground with the peg penetrating the ground along part only of its full length.

Preferably the coupling arrangement includes a pair of longitudinally spaced flanges mounted to the associated peg. More preferably a lowermost of the pair of flanges is in the first install mode configured to contact the upper surface of the support member. Even more preferably an uppermost of the pair of flanges is in the second install mode configured to couple to the fitting, and the lowermost of the flanges is configured to contact the lower surface for suspension of the drainage channel.

Preferably the support member is elongate and includes a pair of openings at respective of its opposing ends, the pair of pegs designed for sliding receipt through respective of the pair of openings. More preferably the lowermost flange of the coupling arrangement is configured relative to the corresponding opening of the support member to prevent passage of the lowermost flange through the opening where either i) the lowermost flange in the first install mode contacts the upper surface of the support member in anchoring it to the ground via the associated peg with substantially full ground penetration, or ii) the lowermost flange in the second install mode contacts the lower surface of the support member in suspending the drainage channel above the ground. Even more preferably the uppermost flange of the coupling arrangement in the second install mode is configured relative to the corresponding opening of the support member for insertion of the uppermost flange through the opening for coupling to the fitting which contacts the upper surface of the support member to prevent retraction of the uppermost flange through the opening, the lowermost and uppermost flanges in combination with the fitting being effective in suspension of the support member above the ground.

Preferably the coupling arrangement is integral with the peg wherein the pair of spaced flanges are rigidly mounted to the peg. More preferably the uppermost of the flanges is located at an end of the associated peg at least in part forming a head adapted to cooperate with a tool designed for penetration of an opposing end portion of the peg into the ground. Even more preferably the opposing end portion of the peg is formed in a spearhead and the head of the coupling arrangement designed for hammering of the peg into the ground.

Preferably the fitting includes a base mounting designed to facilitate detachable mounting of the fitting to the uppermost of the flanges of the coupling arrangement. More preferably the fitting also includes a chair coupled to the base mounting for supporting a concrete reinforcing element above the support member. Even more preferably the chair includes a clip formed integral with the base mounting for releasable engagement and retention of the reinforcing element at a fixed height above the support member. Alternatively the chair is detachably mounted at one of a plurality of heights to an upright member connected to the base mounting, the chair thus being arranged to support the reinforcing element at a select height depending on said one of the plurality of heights at which the chair is mounted to the upright member.

Preferably the support member is adapted to releasably couple to the drainage channel for anchoring it to the support member. More preferably the support member is configured to interlock with one or more feet of the drainage channel.

BRIEF DESCRIPTION OF DRAWINGS

In order to achieve a better understanding of the nature of the present invention a preferred embodiment of a drainage channel support assembly together with a peg assembly will now be described, by example only, with reference to the accompanying drawings in which.

DETAILED DESCRIPTION

As seen in FIGS. 1 to 5 there is one embodiment of a drainage channel support assembly 10 according to a first aspect of the invention. The drainage channel support assembly 10 generally comprises a support member 12 adapted to support drainage channel 14, a pair of pegs 16*a* and 16*b* arranged to anchor the support member 12 to the ground, and a pair of coupling arrangements 18*a* and 18*b* mounted to respective of each of the pair of pegs 16*a* and 16*b*.

Figure 1:
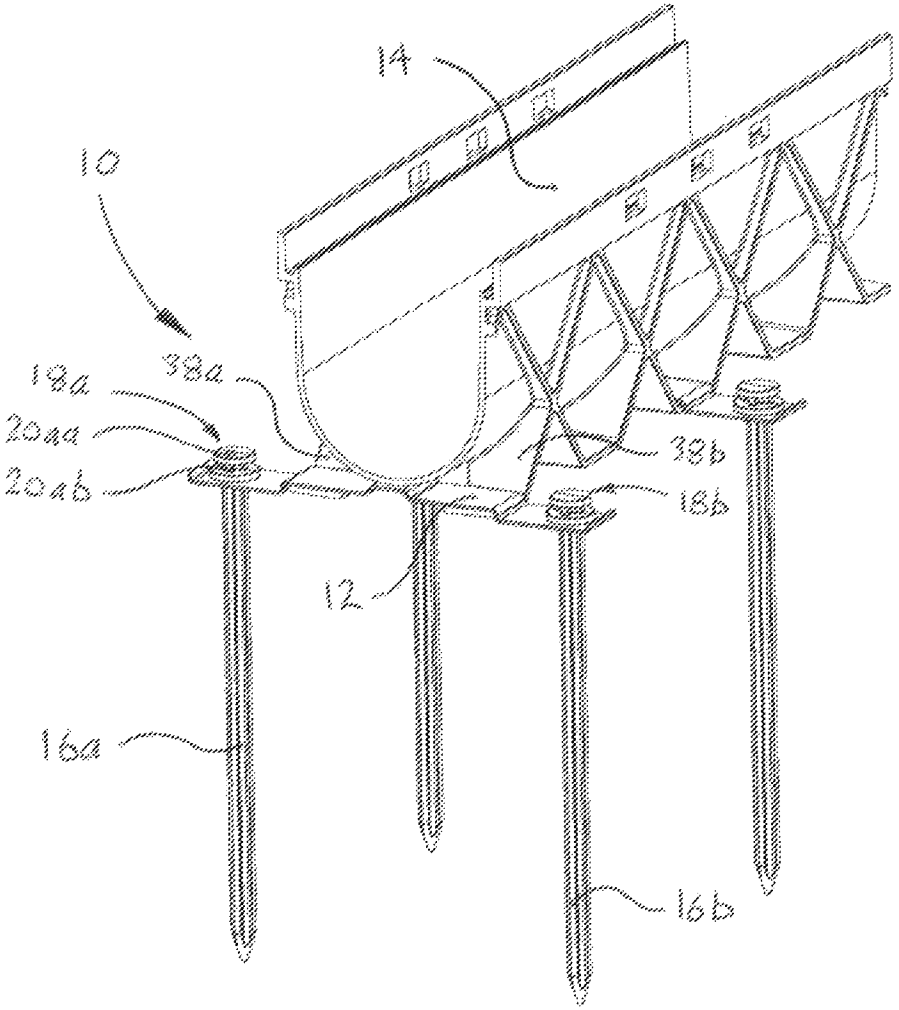
FIG. 1 is a perspective view of one embodiment of a drainage channel support assembly according to a first aspect of the invention in a first install mode.
Figure 2:
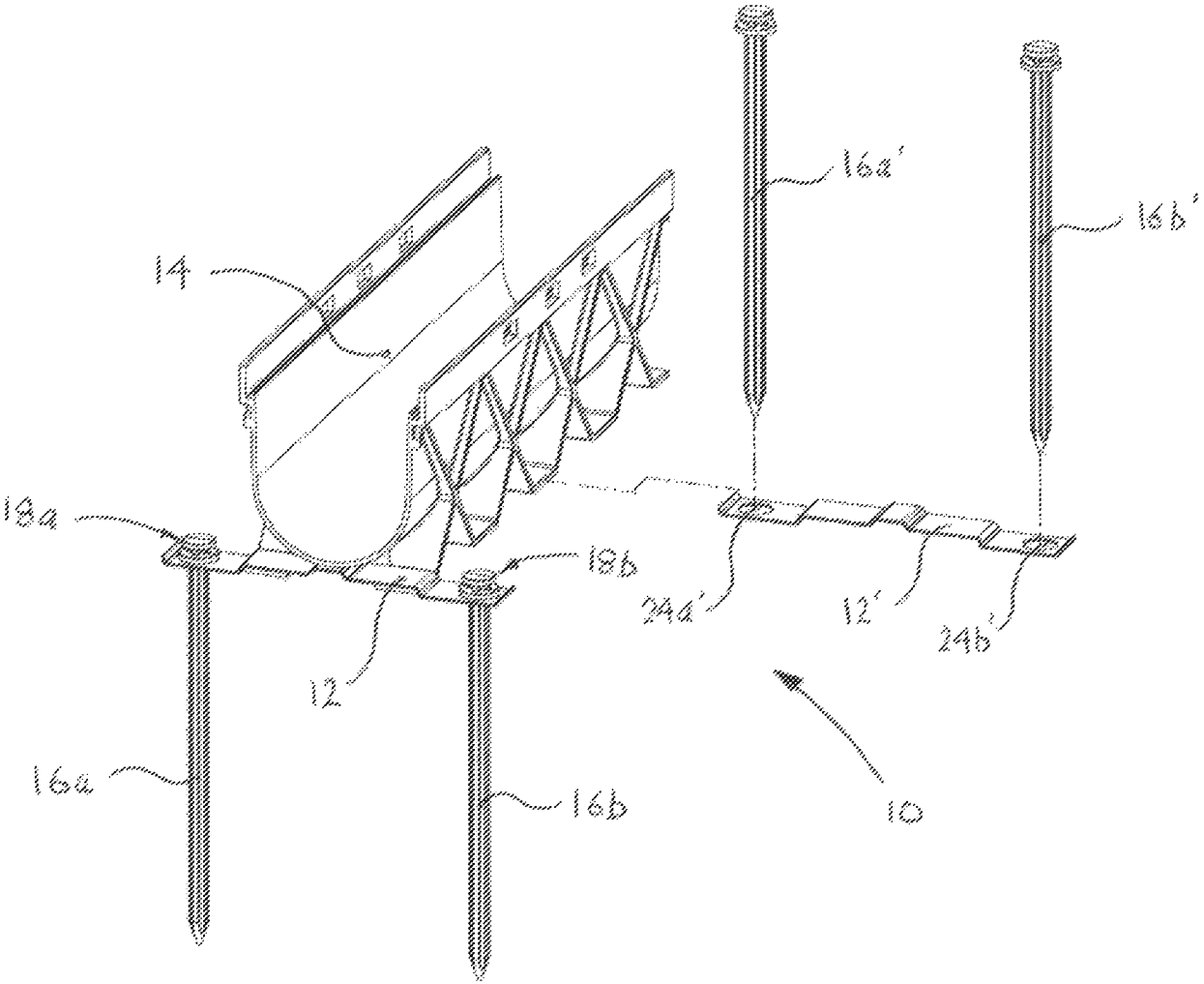
FIG. 2 is a part exploded view shown in perspective of the drainage channel support assembly of the embodiment of FIG. 1.
Figure 3:
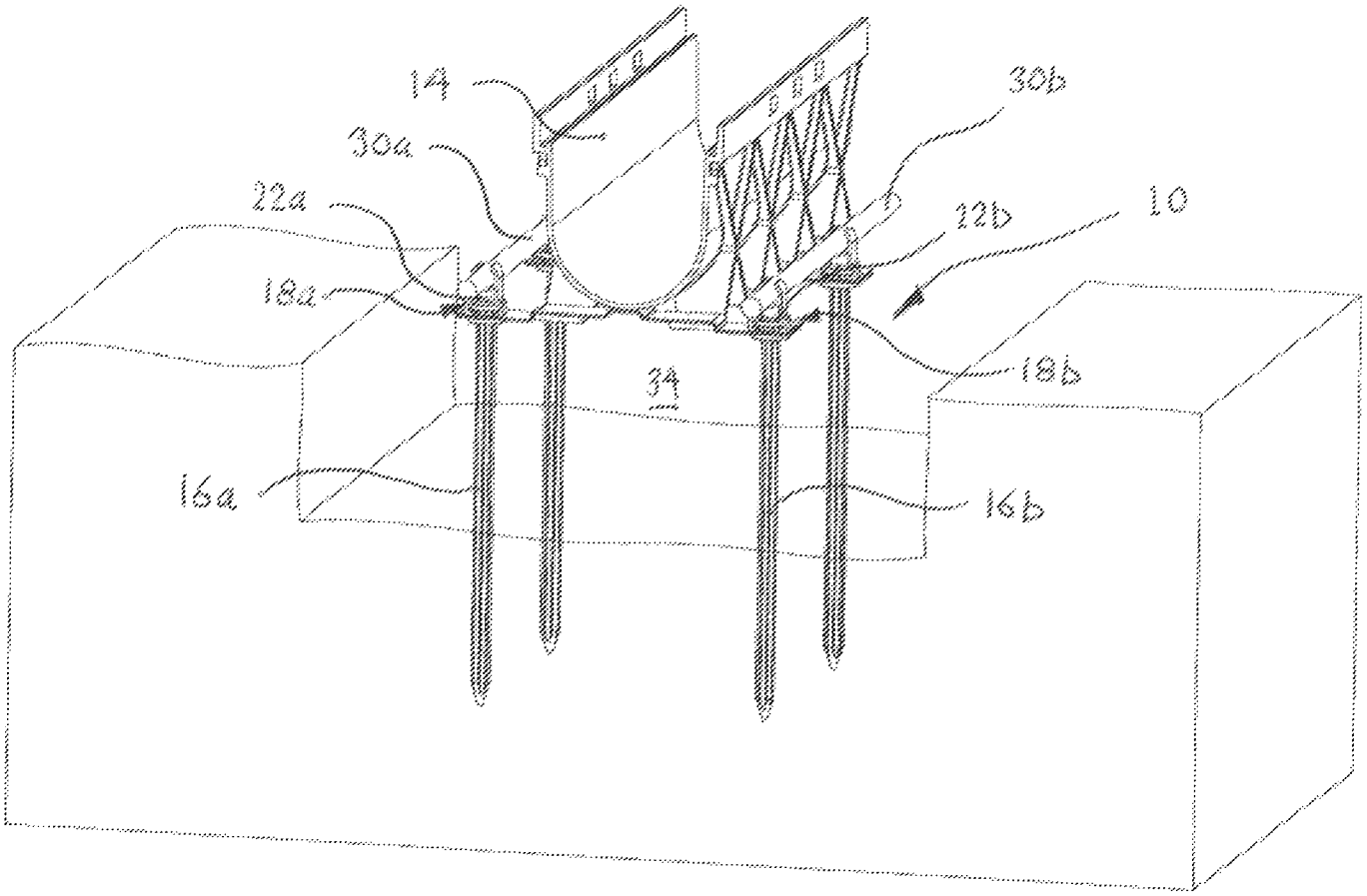
FIG. 3 is a perspective view of the drainage channel support assembly of the embodiment of the preceding figures together with fittings in a second install mode.
Figure 4:
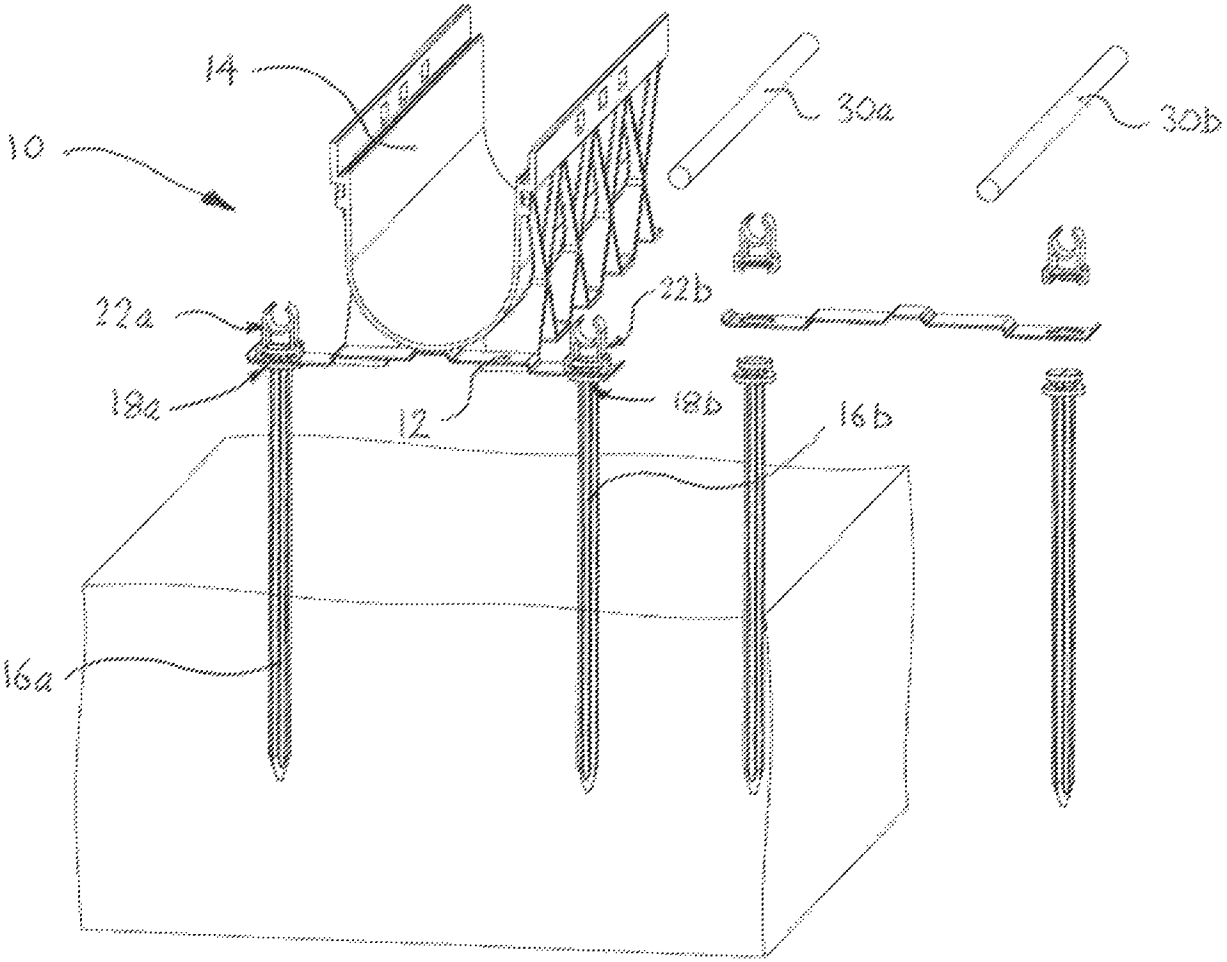
FIG. 4 is a part exploded view shown in perspective of the drainage channel support assembly of the embodiment of FIG. 3.

In this embodiment the coupling arrangement such as 18*a* includes a pair of longitudinal spaced flanges 20*aa* and 20*ab* mounted to the associated peg 16*a*. The pair of flanges such as 20*aa/ab* are configured where on anchoring of the support member 12 to the ground via respective of the pair of pegs 16*a/b* either:

1. in a first install mode for the drainage channel 14, a lowermost of the flanges 20*ab* contacts an upper surface of the support member 12 with the associated peg 16*a* penetrating the ground along substantially the full length of the peg 16*a* beneath the lowermost flange 20*ab* (see FIG. 1 and 2); or
2. in a second install mode for the drainage channel 14, an uppermost of the flanges 20*aa* couples to a fitting 22*a* which contacts the upper surface of the support member 12, the lowermost flange 20*ab* contacting a lower surface of the support member 12 for suspension of the drainage channel 14 above the ground with the peg 16*a* penetrating the ground along part only of its full length (see FIGS. 3 and 4).

In the first install mode, the drainage channel support assembly is typically installed in a softscape application in which case the drainage channel is generally surrounded in soil or other landscaping material. In the second install mode, the drainage channel is typically suspended above ground in a trench in preparation for a concrete pour which will surround the drainage channel.

In this embodiment the support member 12 is elongate and includes a pair of openings 24*a* and 24*b* at respective of its opposing ends (see FIG. 5), the pair of pegs 16*a/b* designed for sliding receipt through respective of the pair of openings 24*a/b*. The lowermost flange such as 20*ab* of the coupling arrangement 18*a* is configured relative to the corresponding opening 24*a* to prevent passage of the lowermost flange 20*ab*. This means the lowermost flange such as 20*ab* is configured where either (i) in the first install mode, it contacts the upper surface of the support member 12 in anchoring it to the ground via the associated peg 16*a* with substantially full ground penetration (see FIGS. 1 and 2), or (ii) in the second install mode, it contacts the lower surface of the support member 12 in suspending the drainage channel 14 above the ground (see FIGS. 3 and 4). In the second install mode for this embodiment, the uppermost flange such as 20*aa* is configured relative to the corresponding opening 24*a* of the support member 12 for insertion of the uppermost flange 20*aa* through the corresponding opening 24*a*. The uppermost flange 20*aa* then exposes itself to the fitting such as 22*a* to which it is coupled to prevent retraction of the uppermost flange 20*aa* through the opening 24*a*. The fitting 22*a* thus contacts the upper surface of the support member 12 wherein the uppermost and lowermost flanges 20*aa/ab* in combination of with the fitting 22*a* are effective in suspension of the support member 12 and the associated drainage channel 14 above the ground.

In this embodiment the coupling arrangement such as 18*a* is formed integral with the peg 16*a* where the pair of spaced flanges 20*aa/ab* are rigidly mounted to the peg 16*a*. The uppermost of the flanges 20*aa* is located at an end of the associated peg 16*a* thereby forming a head adapted to cooperate with a tool (not shown) design for penetration of the peg 16*a* into the ground. In this example the peg 16*a* is at its opposing end formed in a spearhead which together with the head or uppermost flange 20*aa* is designed for hammering of the peg 16*a* into the ground.

Figure 5:
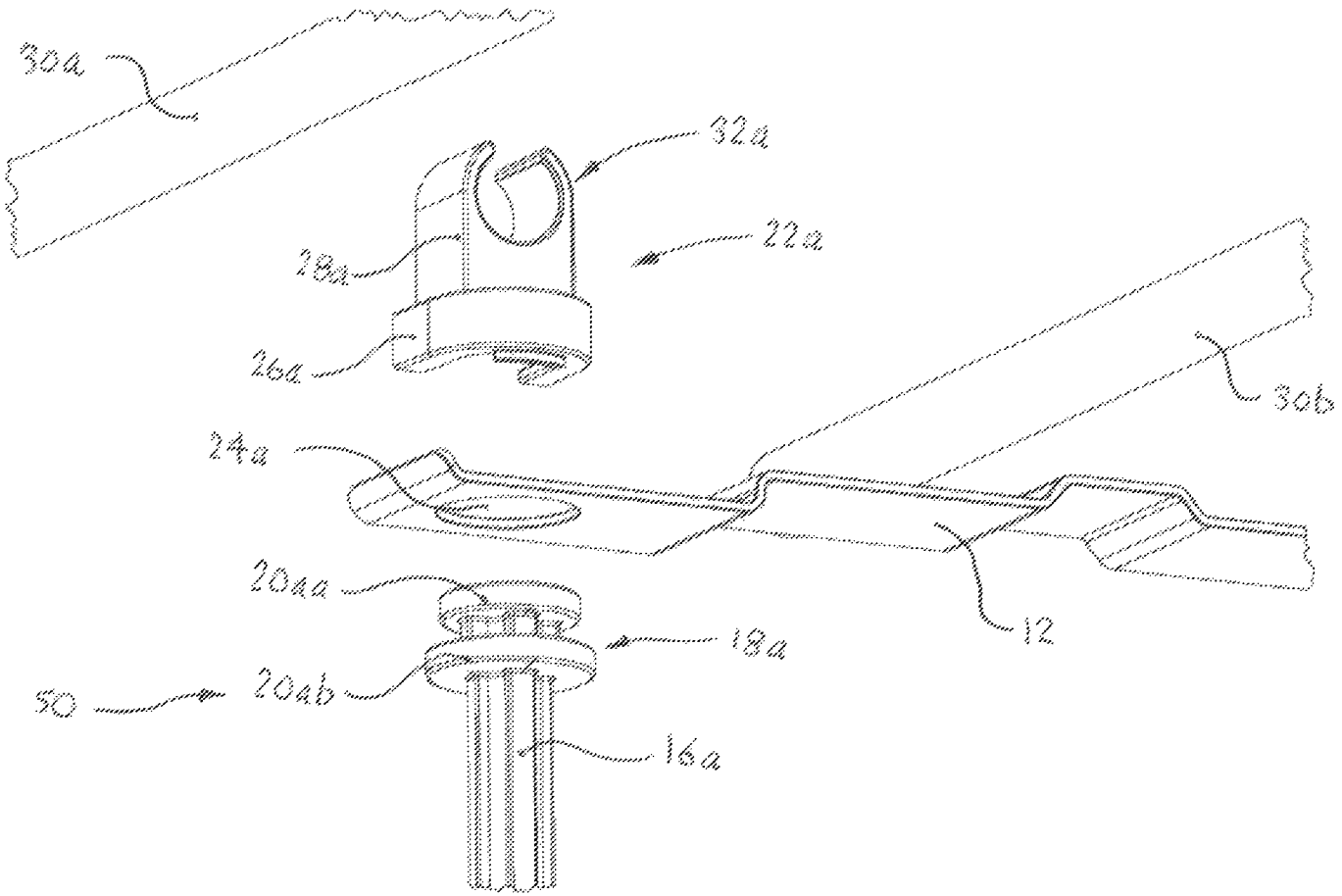
FIG. 5 is a part exploded view shown in detail of a peg assembly according to second aspect of the invention and taken from the drainage channel support assembly of the first aspect of FIGS. 3 and 4.

As best seen in FIG. 5, the fitting such as 22*a* includes a base mounting 26*a* designed to facilitate detachable mounting of the fitting 22*a* to the uppermost flange 20*aa* of the coupling arrangement 18*a*. The fitting 22*a* also includes a chair 28*a* formed integral with the base mounting 26*a*, the chair 28*a* being adapted to support a concrete reinforcing element such as a reinforcing bar 30*a*. The chair 28*a* of this example includes a clip 32*a* for releasable engagement and retention of the reinforcing bar 30*a* above the support member 12. The fitting 22*a* is designed to rotate about the coupling arrangement 18*a* so that it can be oriented to align with the reinforcing bar 30*a* or other reinforcing element. As best seen in FIG. 3, the drainage channel support assembly 10 together with the associated drainage channel 14 and reinforcing bars such as 30*a* and 30*b* are located within a ground trench 34. The drainage channel support assembly 10 is driven within the ground to locate the drainage channel 14 within the trench 34 which is filled with concrete burying the reinforcing bars 30*a* and 30*b*.

Figure 6:
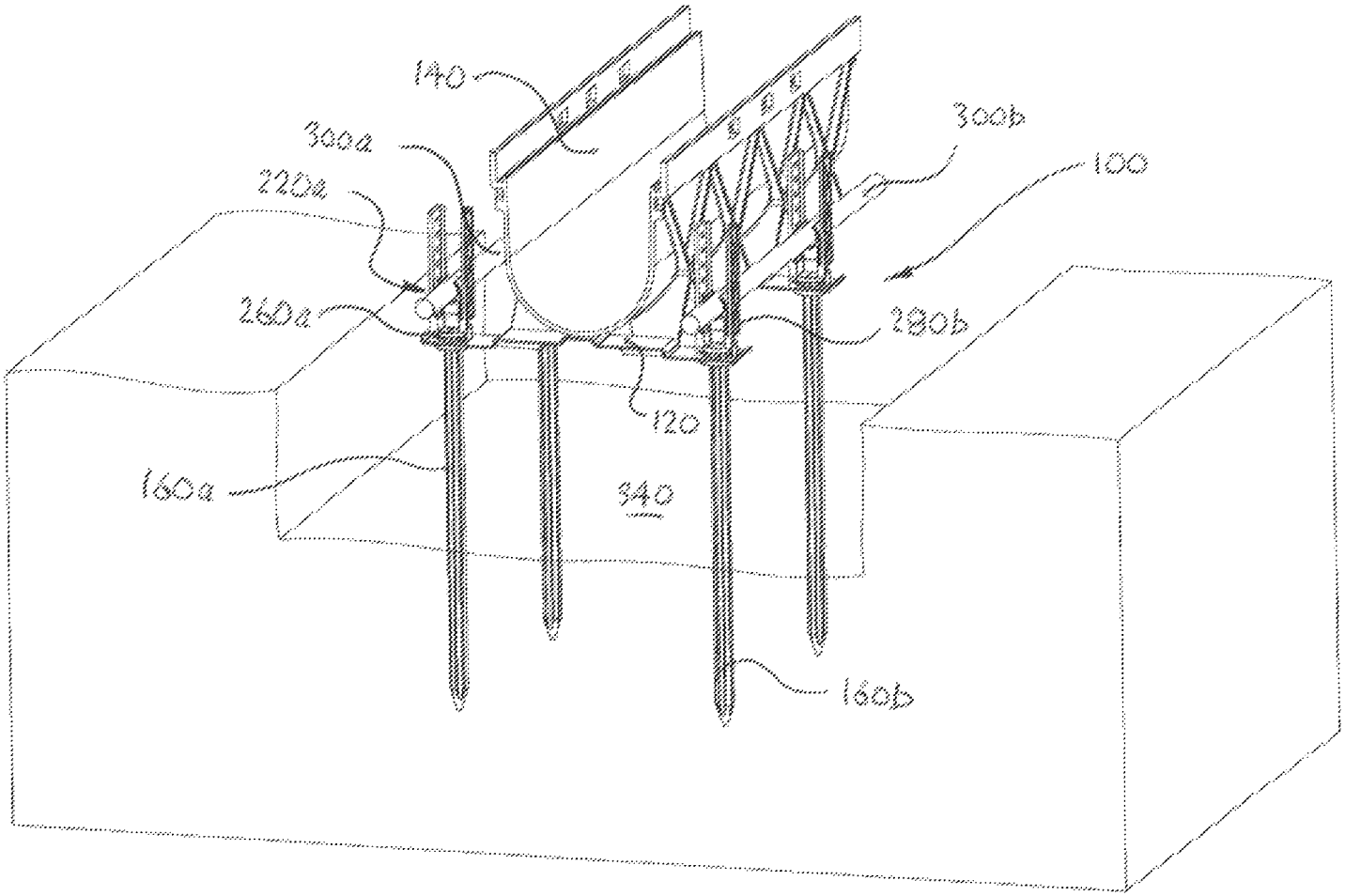
FIG. 6 is a perspective view of another embodiment of the drainage channel support assembly of the first aspect of the invention in a second install mode including different fittings from the preceding embodiment.
Figure 7:
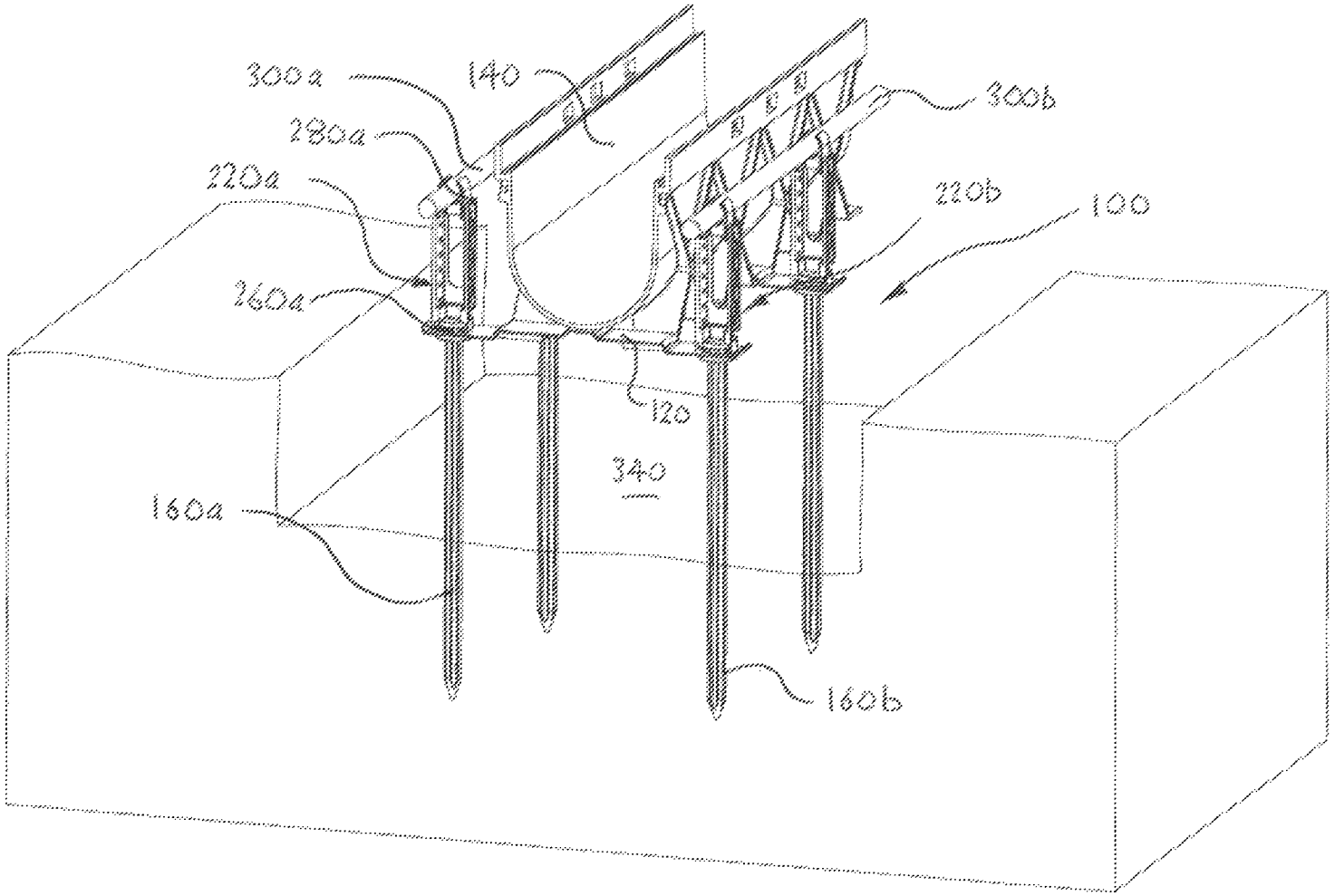
FIG. 7 is a perspective view of the drainage channel support assembly of the embodiment of FIG. 6 with the associated cradles of the fittings in a different position.
Figure 8:
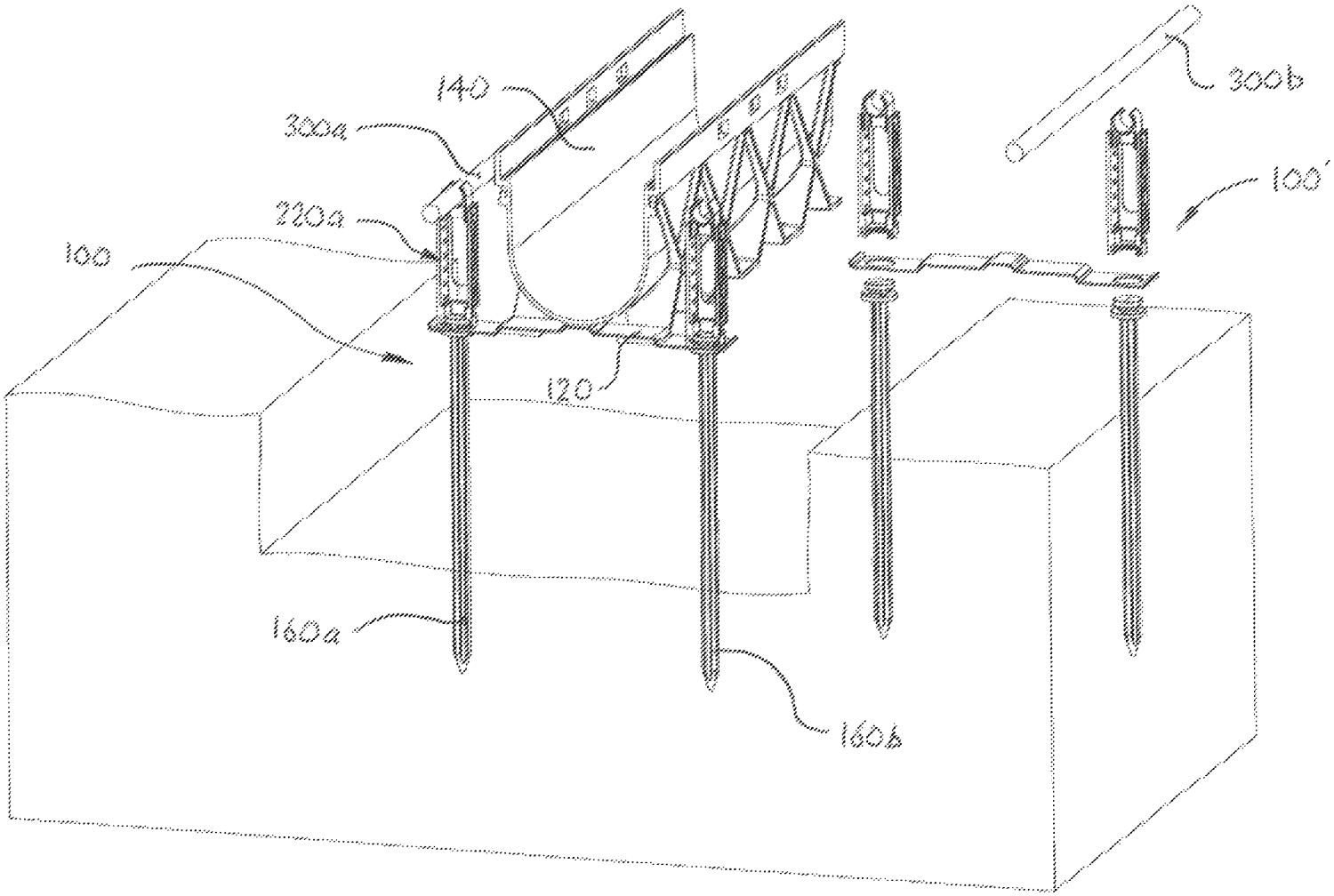
FIG. 8 is a part exploded view shown in perspective of the drainage channel support assembly of the embodiment of FIG. 7.

FIGS. 6 to 8 illustrate another embodiment of a drainage channel support assembly 100 in this second mode of install to be located in a concrete surround poured in a trench. For ease of reference and in order to avoid repetition, corresponding components of this other embodiment have been designated with an additional "0" to the preceding embodiment. For example, the pegs have been designated at 160*a* and 160*b*.

Figure 9:
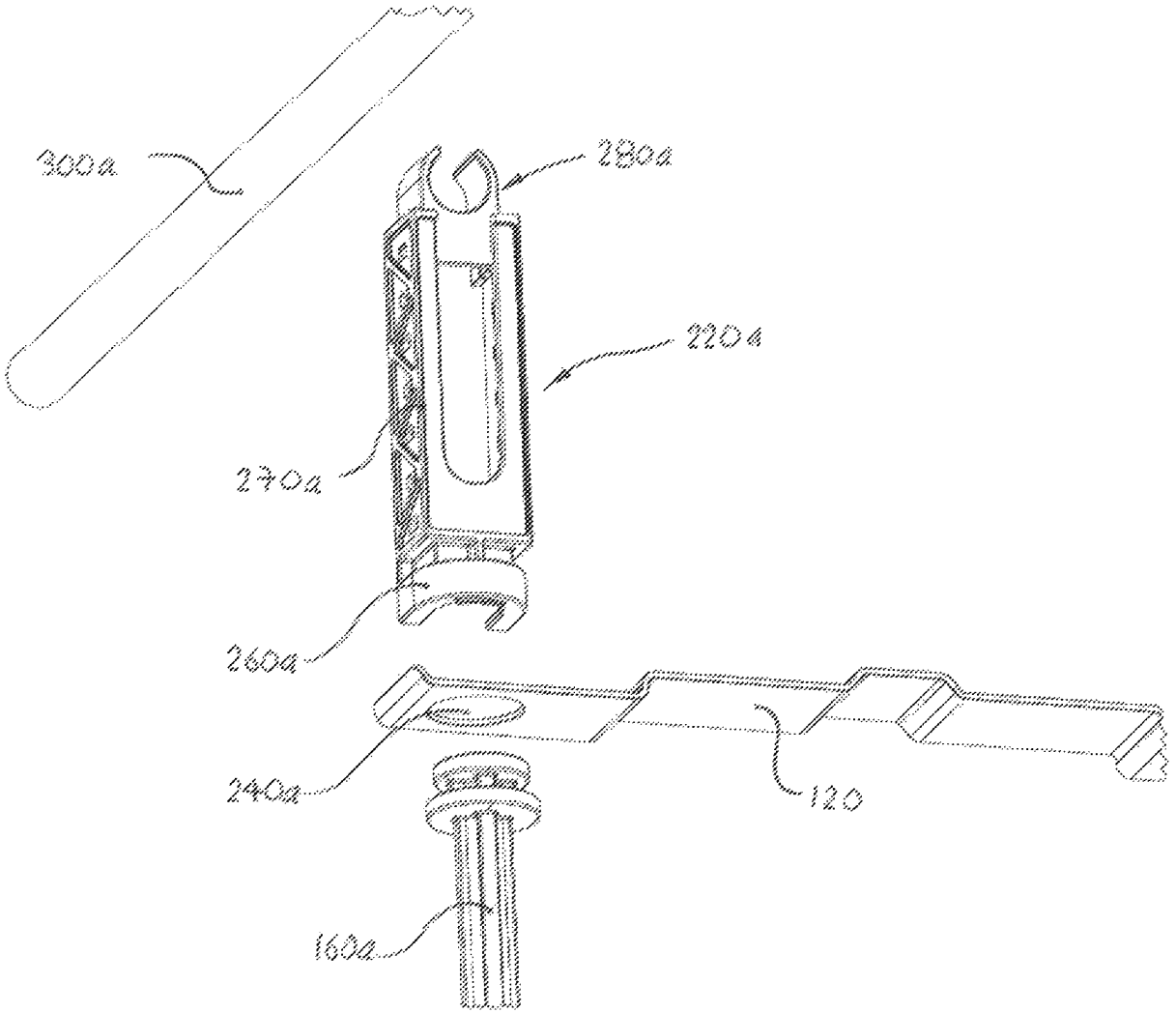
FIG. 9 is an exploded view shown in perspective of a peg assembly of another embodiment of the second aspect of the invention taken from the drainage channel support assembly of FIGS. 6 to 8.
Figure 10:
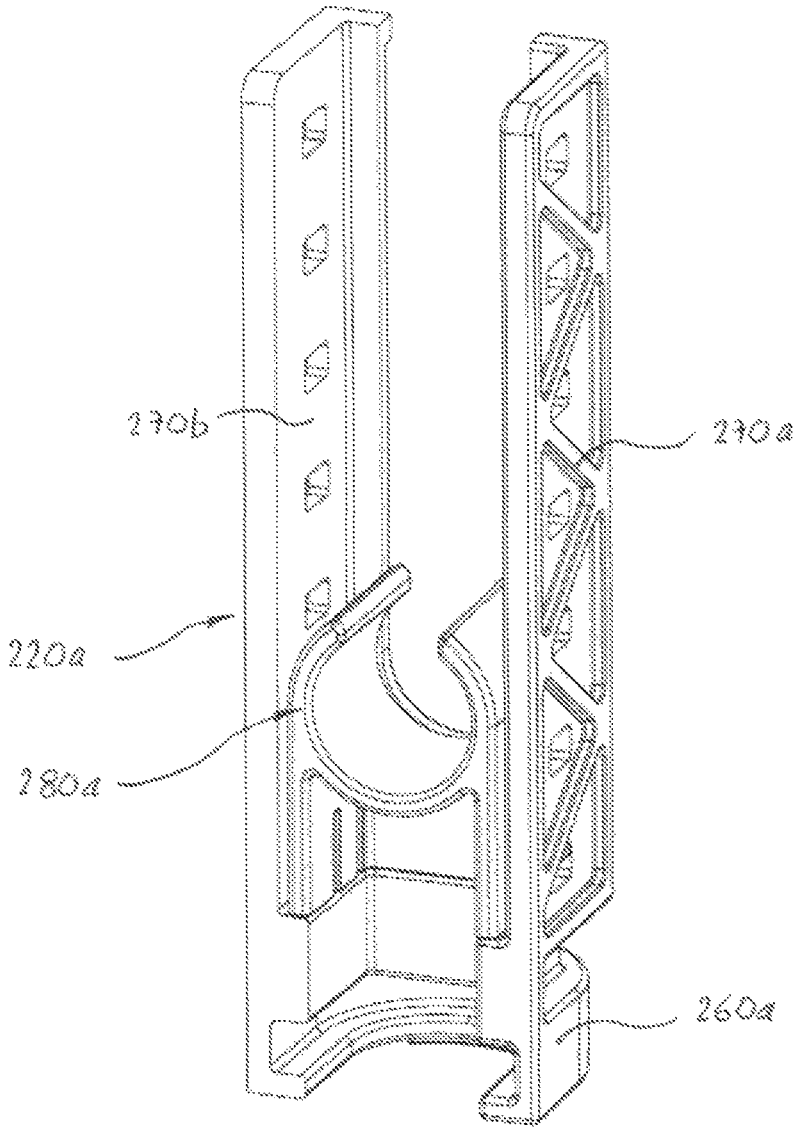
FIGS. 10 and 11 are perspective views of the fitting taken from the drainage channel support assembly of FIGS. 7 and 8 shown with the associated cradles in their different positions.
Figure 11:
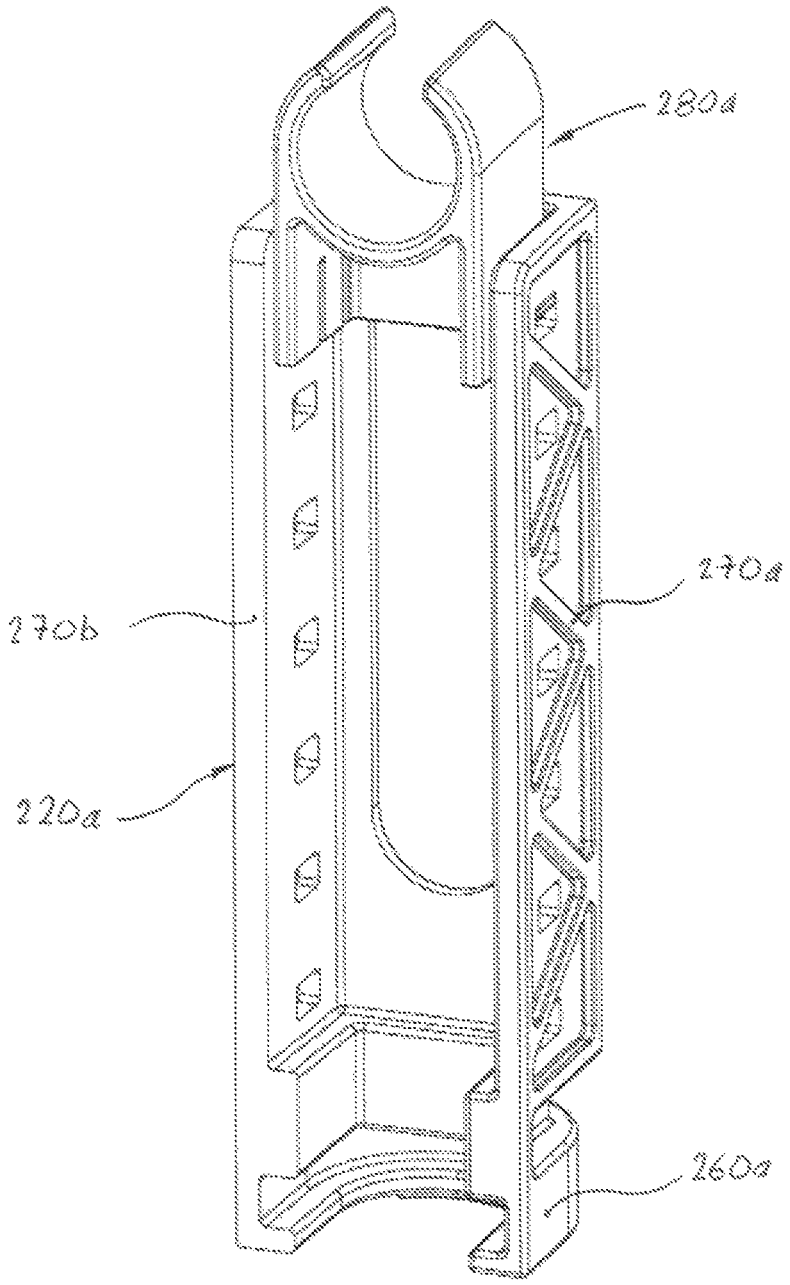

In this embodiment the drainage channel support assembly 100 includes a variation on the fitting 22*a* of the preceding embodiment which provided a fixed height for supporting the concrete reinforcing element above the support member 12. In this variation the fitting 220*a* includes a chair 280*a* movably coupled to a base mounting 260*a* for supporting the reinforcing element such as 300*a* at a select height. As best seen in FIG. 9, the base mounting 260*a* connects to a pair of upright members such as 270*a* in the form of opposing rail members within which the chair 280*a* is releasably clipped at one of a plurality of heights. FIG. 10 shows the chair 280*a* at its lowermost level whereas FIG. 11 shows the chair 280*a* at its most raised level. It will be understood that the chairs such as 280*a* can thus be manipulated within the upright rail members 270*a* of the fitting 220*a* to set the associated reinforcing bar 300*a* at its required height for burying within the concrete. This means the reinforcing bars such as 300*a* and 300*b* can be located not only at different heights relative to one another but at different heights relative to the drainage channel such as 140.

Figure 12:
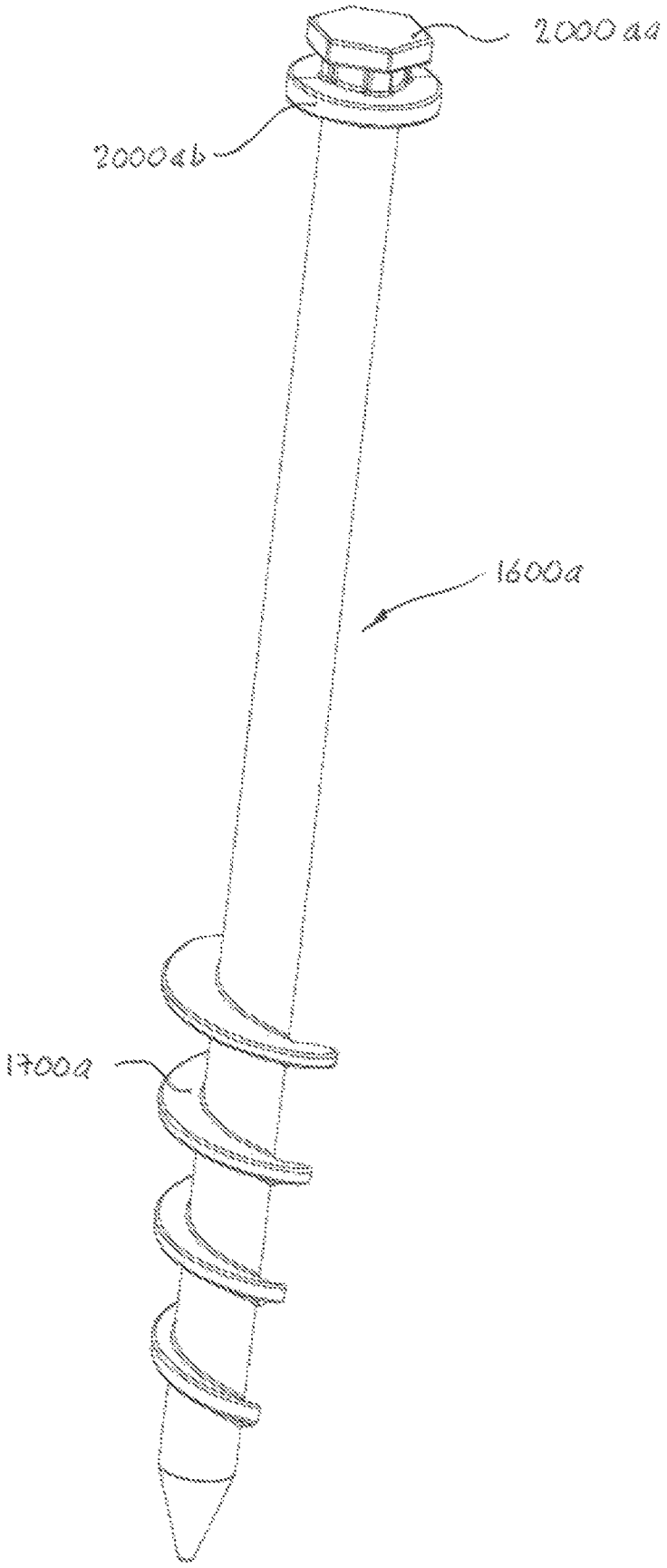
FIG. 12 is a perspective view of a peg of an alternative embodiment of a drainage channel support assembly or peg assembly according to either aspect of the invention.
Figure 13:
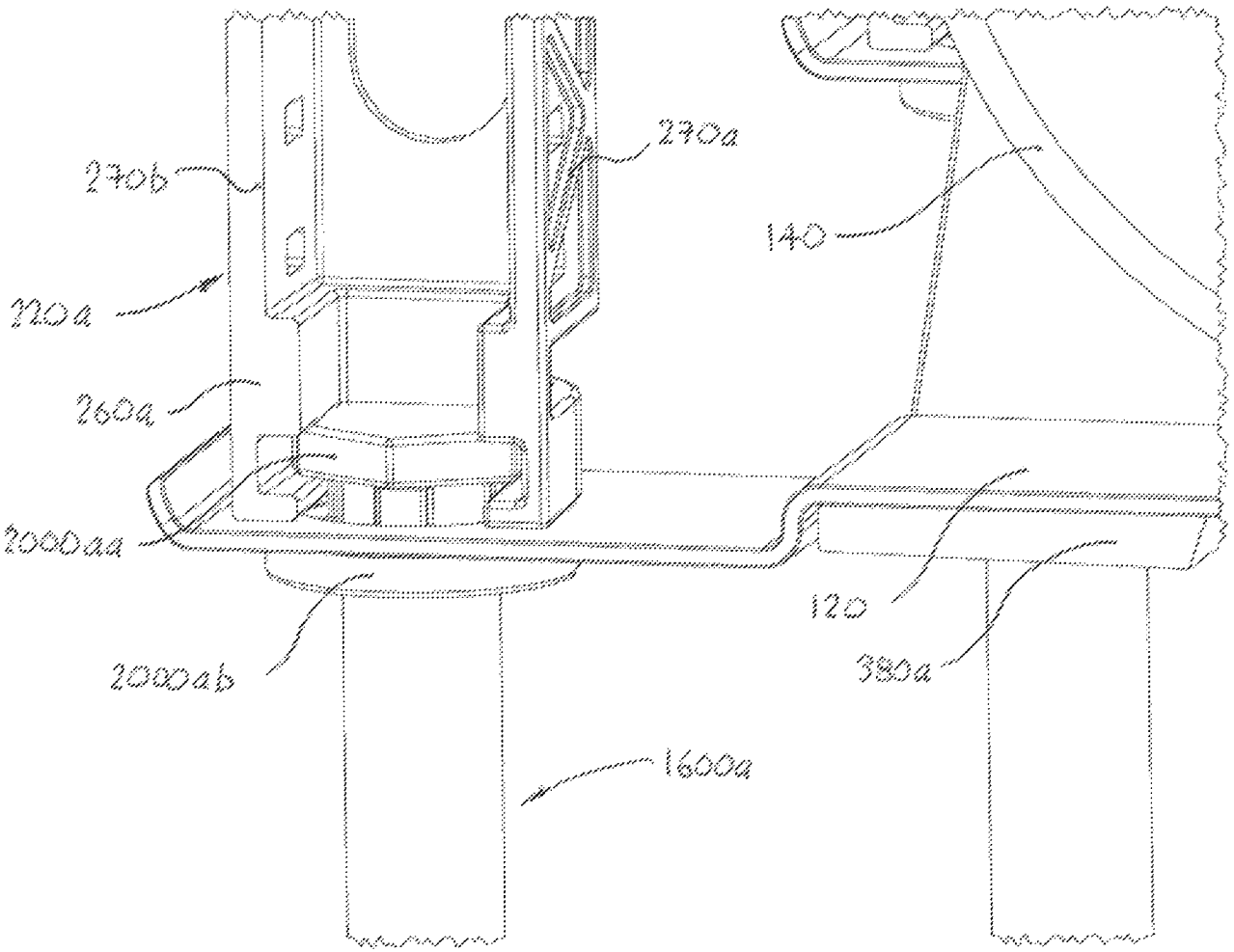
FIG. 13 is enlarged perspective view of the drainage channel support assembly of the embodiment of the preceding figures including the alternative peg of FIG. 12 in a second install mode.

FIGS. 12 and 13 illustrate an alternative peg 1600*a* to be installed in either the first mode without or the second mode together with the fitting such as 220*a* of the preceding embodiment. The alternative peg 1600*a* is substantially identical to the preceding peg 16*a* or 160*a* except:

1. the head or uppermost flange 2000*aa* is formed as a hexagonal head appropriate for rotation via a wrench or other tool (not shown);
2. the peg 1600*a* includes a helical screw 1700*a* located about midway along its shank for screwing of the peg 1600*a* into the ground to adjust its height once the opposing end portion has been hammered into the ground.

In this embodiment and as seen in FIGS. 1 to 4, the elongate support member 12 is shaped to releasably couple to feet such as 38*a* and 38*b* associated with the drainage channel 14. The elongate support member 12 is constructed of a resiliently flexible material designed to interlock with the associated feet 38*a/b* of the drainage channel 14. It will be understood that the support member may vary in its configuration depending on the underneath shape of the drainage channel and/or its associated feet with which the support member 12 is to be fitted.

It should be understood that the described and illustrated embodiments of the invention are limited to a single and truncated drainage channel. In practice, the drainage channel may be of a modular construction with substantially identical drainage channel modules being joined end-to-end. This modular configuration for the drainage channel is unlikely to impact on the design of the associated drainage channel support assembly of the invention.

In a second aspect of the invention and as best seen in FIG. 5, there is a peg assembly 50 taken from the various embodiments of the drainage channel support assembly such as 10 or 100 of the first aspect of the invention. The peg assembly 50 of these embodiments generally comprises the peg such as 16*a*, and the associated coupling arrangement such as 18*a*. The peg 16*a* is adapted to cooperate with the support member such as 12 designed to support the drainage channel 14 as described in the context of the preferred embodiment of the first aspect of the invention. Likewise, the coupling arrangement 18*a* is configured to cooperate with the support member 12 or fitting such as 22*a* in the first or second install modes.

Now that several preferred embodiments of a drainage channel support assembly and peg assembly have been described it will be apparent to those skilled in the art that they have the following advantages:

1. the drainage channel support assembly lends itself to installation in both softscape and concrete pour applications;
2. the drainage channel support assembly may be adapted by reconfiguring the support member to suit a wide range of different shaped drainage channels;
3. in its concrete pour application, the drainage channel support assembly provides integrated support for a concrete reinforcing element providing additional support for concrete adjacent the associated drainage channel;
4. in the concrete pour application, the drainage channel support assembly may include a fitting having the ability to mount to the support assembly at select heights depending on the required height at which the reinforcing element is to be set relative to the drainage channel.

Those skilled in the art will appreciate that the invention as described herein is susceptible to variations and modifications other than those specifically described. For example, the coupling arrangement associated with the peg may depart from the spaced flanges of the preferred embodiments provided the support member is for both modes of install anchored at the required disposition relative to the ground. The fitting coupled to the coupling arrangement need not be designed for supporting a concrete reinforcing element but in its simpler form may function to releasably retain the coupling arrangement to the support member. The head of the peg may vary where for instance the hexagonal-shaped head is replaced with a head designed for rotation via an Allen key or wrench. In the event that the drainage channel support assembly accommodates a concrete reinforcing element, the reinforcing bar of the described embodiments may be replaced with reinforcing mesh, grid sheet, or other reinforcing structure. All such variations and modifications are to be considered within the scope of the present invention the nature of which is to be determined from the foregoing description.

The invention claimed is:

1. A drainage channel support assembly comprising:

a support member adapted to locate underneath a drainage channel to support it, the support member being elongate and including a pair of openings at respective of its opposing ends;

a pair of pegs arranged to cooperate with the support member, wherein the pair of pegs are configured for sliding receipt through respective of the pair of openings for anchoring of the support member to the ground; and a pair of coupling arrangements mounted to respective of each of the pair of pegs, each of said coupling arrangements including a pair of longitudinally spaced flanges mounted to the associated peg, said coupling arrangement being configured where on anchoring of the support member to the ground via respective of the pair of pegs, said coupling arrangement either in:

a first install mode for the drainage channel, a lowermost flange of the pair of flanges contacts an upper surface of the support member with the associated peg penetrating the ground along substantially the full length of the peg beneath the coupling arrangement, a second install mode for the drainage channel, an uppermost flange of the pair of flanges is configured to couple to a fitting which contacts the upper surface of the support member, the lowermost flange of the pair of flanges is configured to contact a lower surface of the support member for suspension of the drainage channel above the ground with the peg penetrating the ground along part only of its full length, the uppermost flange of the coupling arrangement in the second install mode being configured relative to the corresponding opening of the support member for insertion of the uppermost flange through the opening for coupling to the fitting which contacts the upper surface of the support member to prevent retraction of the uppermost flange through the opening, the lowermost flange and the uppermost flange in combination with the fitting being effective in suspension of the support member above the ground.

2. A drainage channel support assembly as claimed in claim 1 wherein the lowermost flange of the coupling arrangement is configured relative to the corresponding opening of the support member to prevent passage of the lowermost flange through the opening where either i) the lowermost flange in the first install mode contacts the upper surface of the support member in anchoring it to the ground via the associated peg with substantially full ground penetration, or ii) the lowermost flange in the second install mode contacts the lower surface of the support member in suspending the drainage channel above the ground.

3. A drainage channel support assembly as claimed in claim 1 wherein the coupling arrangement is integral with the peg wherein the pair of spaced flanges are rigidly mounted to the peg, the uppermost of the flanges being located at an end of the associated peg at least in part forming a head adapted to cooperate with a tool configured for penetration of an opposing end portion of the peg into the ground.

4. A drainage channel support assembly as claimed in claim 3 wherein the opposing end portion of the peg is formed in a spearhead and the head of the coupling arrangement is configured for hammering of the peg into the ground.

5. A drainage channel support assembly as claimed in claim 4 wherein the fitting includes a base mounting configured to facilitate detachable mounting of the fitting to the uppermost of the flanges of the coupling arrangement.

6. A drainage channel support assembly as claimed in claim 5 wherein the fitting also includes a chair coupled to the base mounting for supporting a concrete reinforcing element above the support member, the chair including a clip formed integral with the base mounting for releasable engagement and retention of the reinforcing element at a fixed height above the support member.

7. A drainage channel support assembly as claimed in claim 6 wherein the chair is detachably mounted at one of a plurality of heights to an upright member connected to the base mounting, the chair thus being arranged to support the reinforcing element at a select height depending on said one of the plurality of heights at which the chair is mounted to the upright member.

8. A drainage channel support assembly as claimed in claim 1 wherein the support member is adapted to releasably couple to the drainage channel for anchoring it to the support member, the support member being configured to interlock with one or more feet of the drainage channel.

9. A peg assembly comprising:

a peg adapted to cooperate with a support member designed to support a drainage channel; and a coupling arrangement including a pair of longitudinally spaced flanges mounted to the peg, said coupling arrangement being configured where on anchoring of the support member to the ground via the peg in:

a first install mode for the drainage channel, a lowermost flange of the pair of flanges contacts an upper surface of the support member with the associated peg penetrating the ground along substantially the full length of the peg beneath the coupling arrangement, a second install mode for the drainage channel, an uppermost flange of the pair of flanges is configured to couple to a fitting which contacts the upper surface of the support member, the lowermost flange of the pair of flanges configured to contact a lower surface of the support member for suspension of the drainage channel above the ground with the peg penetrating the ground along part only of its full length, the coupling arrangement being integral with the peg wherein the pair of spaced flanges is rigidly mounted to the peg, the uppermost flange of the pair of flanges being located at an end of the peg at least in part forming a head adapted to cooperate with a tool configured for penetration of an opposing end portion of the peg into the ground.

10. A peg assembly as claimed in claim 9 wherein the opposing end portion of the peg is formed in a spearhead and the head of the coupling arrangement is configured for hammering of the peg into the ground.

11. A peg assembly as claimed in claim 9 wherein the fitting includes a base mounting configured to facilitate detachable mounting of the fitting to the uppermost of the flanges of the coupling arrangement.

12. A peg assembly as claimed in claim 11 wherein the fitting also includes a chair coupled to the base mounting for supporting a concrete reinforcing element above the support member, the chair including a clip formed integral with the base mounting for releasable engagement and retention of the reinforcing element at a fixed height above the support member.

13. A peg assembly as claimed in claim 12 wherein the chair is detachably mounted at one of a plurality of heights to an upright member connected to the base mounting, the chair thus being arranged to support the reinforcing element at a select height depending on said one of the plurality of heights at which the chair is mounted to the upright member.

* * * * *